United States Patent [19]

Diffrient

[11] Patent Number: 4,986,195

[45] Date of Patent: Jan. 22, 1991

[54] TILTING TABLE TOP MECHANISM

[75] Inventor: Niels Diffrient, Ridgefield, Conn.

[73] Assignee: Howe Furniture Corporation, Trumbull, Conn.

[21] Appl. No.: 250,084

[22] Filed: Sep. 28, 1988

[51] Int. Cl.[5] ..... A47B 13/02

[52] U.S. Cl. ..... 108/150; 108/1; 248/188.6

[58] Field of Search ..... 108/150, 132, 131, 133, 108/157, 153, 1, 6, 8; 403/71, 162; 16/2; 29/141, 142; 248/188.6, 168, 170

[56] References Cited

U.S. PATENT DOCUMENTS

| | | | |
|---|---|---|---|
| 1,203,783 | 10/1916 | Reischmann | 108/132 |
| 3,554,171 | 1/1971 | Burr | 108/132 |
| 3,684,220 | 8/1972 | Logsdon | 16/2 X |
| 3,695,567 | 10/1972 | Weagle | 108/132 X |
| 3,836,698 | 9/1974 | Bawa | 16/2 X |
| 4,643,105 | 2/1987 | Baum | 108/157 X |
| 4,735,534 | 4/1988 | Oehlke | 16/2 X |
| 4,752,652 | 6/1988 | Danti et al. | 16/2 X |

*Primary Examiner*—José V. Chen

*Attorney, Agent, or Firm*—Parmelee, Bollinger & Bramblett

[57] ABSTRACT

A tilting table top mechanism includes a chassis member which is secured to the underside of a table top and a base plate which is secured to the top of a table leg. Exceptional rigidity is achieved by a dual pivot mechanism. The pivots employ novel bearing elements which are easily removed and replaceable. Pivot tabs on the base plate are insertable into recesses, or slots, in the bearing elements. At a given angle of rotation of the table top to the leg, the chassis member and base plate are readily detached. A dual locking mechanism maintains the table top in its normal horizonal position but is manually disengaged with ease.

11 Claims, 6 Drawing Sheets

TILTING TABLE TOP MECHNISM

TECHNICAL FIELD

This invention pertains to the field of top tilting mechanisms for tables. More particularly, it pertains to such mechanisms having improved rigidity and stability when erected and the additional capability of easily attaching and detaching the leg and table top when desired.

BACKGROUND ART

Tables with tilting tops and folding legs are, of course, well known in the art. There has been a continuing effort to provide such tables which, when erected, have the rigidity of conventional non-folding tables. One way of achieving increased rigidity is to reduce the number of the folding legs by making them in an inverted T-shape, thereby reducing the number of folding mechanisms required.

Another method for increasing the rigidity of such a table is to utilize a trestle bar which connects the legs of a two legged table. An example of such a construction may be found in U.S. Pat. No. 4,444,124 of Burr which issued Apr. 24, 1984 and was assigned to the same assignee as the present invention.

An earlier such patent is U.S. Pat. No. 3,818,844 which issued June 25, 1974. The table described in that patent includes a trestle bar connecting two table legs and a stretcher bar extending in the same general direction as the trestle bar. Pins project outwardly from the ends of the stretcher bar. Means are provided to enable each table leg to be unfolded through an arc of more than 90° relative to the underside of the table top. The stretcher bar is rotatable to align the pins projecting from its ends with suitable openings in the top of the table legs. The pins are insertable into the openings and lock the table legs in their unfolded or erected position. Folding the table legs is accomplished by reversing the above steps.

One of the problems with the approaches described above is that they are not applicable to tables having only one leg, such as pedestal tables. Furthermore, it would be desirable if the actual bearing for the tilt top feature were readily interchangeable for purposes of replacement. Also, in prior art tables the connection between leg and table is fixed, albeit foldable. In other words, leg and table are not readily separable. However, ready separability would be desirable for purposes of storage and shipment and for interchanging table tops and legs at will.

Accordingly, it is an object of the present invention to provide a tilt top table mechanism which is simple to operate, yet rigid when erected. Another object is to provide such a mechanism wherein the table top and leg are readily assembled and disassembled as desired. Another object is to provide a mechanism wherein the actual bearing member is readily replaceable. Other objects, features, and advantages will become apparent from the following description and appended claims.

DISCLOSURE OF INVENTION

The present invention comprises a mechanism which permits a table top to be tilted relative to a table leg. The mechanism may be employed with a pedestal type table to permit the table top to be tilted into a vertical position for ease of storage. The mechanism is also designed such that the table top may be easily detached from, or attached to, the leg. This feature permits disassembly for purposes of storage or shipment and also provides interchangeability of table top and leg designs and sizes. Exceptional rigidity is provided by means of a "clamshell" type construction employing a pair of spaced pivots. The pivot bearings are readily removable for replacement. Tilting is spring-assisted and the locking mechanism includes a single actuator handle located in a convenient location near the table edge.

Figure 4:
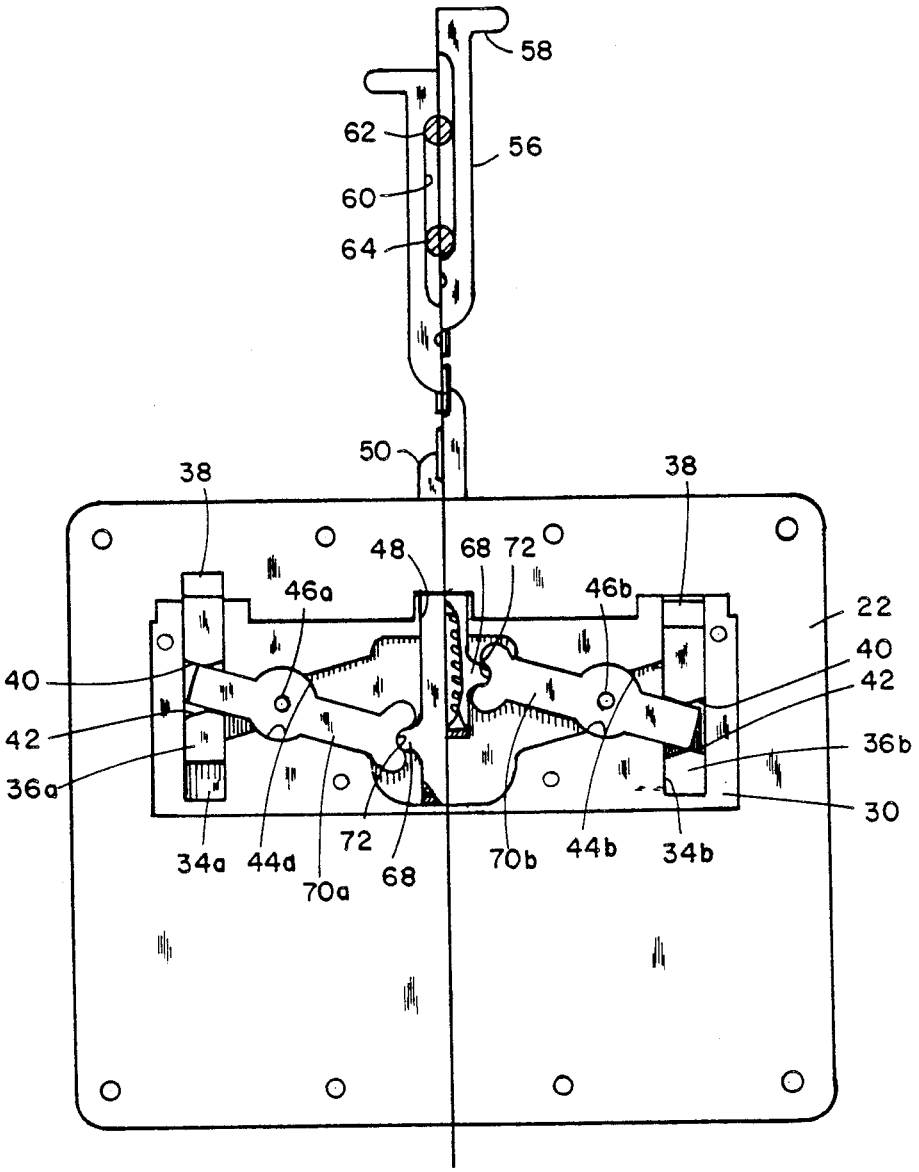
Figure 5:
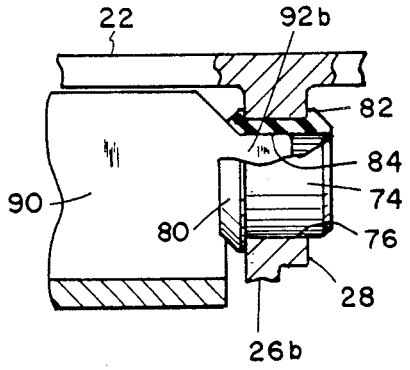
Figure 6:
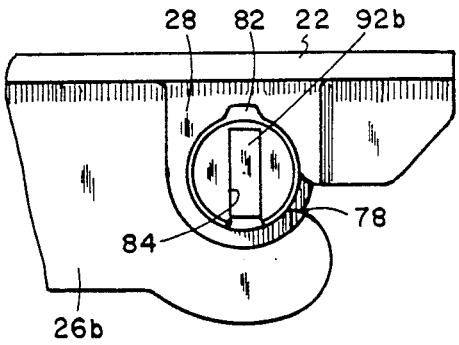
Figure 7:
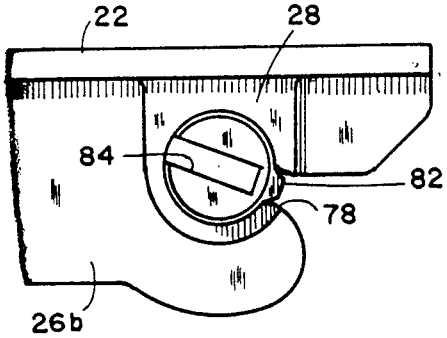
Figure 8:
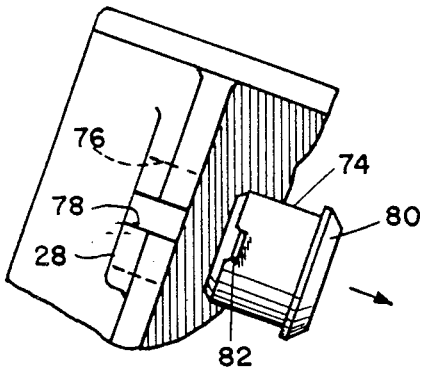
Figure 9:
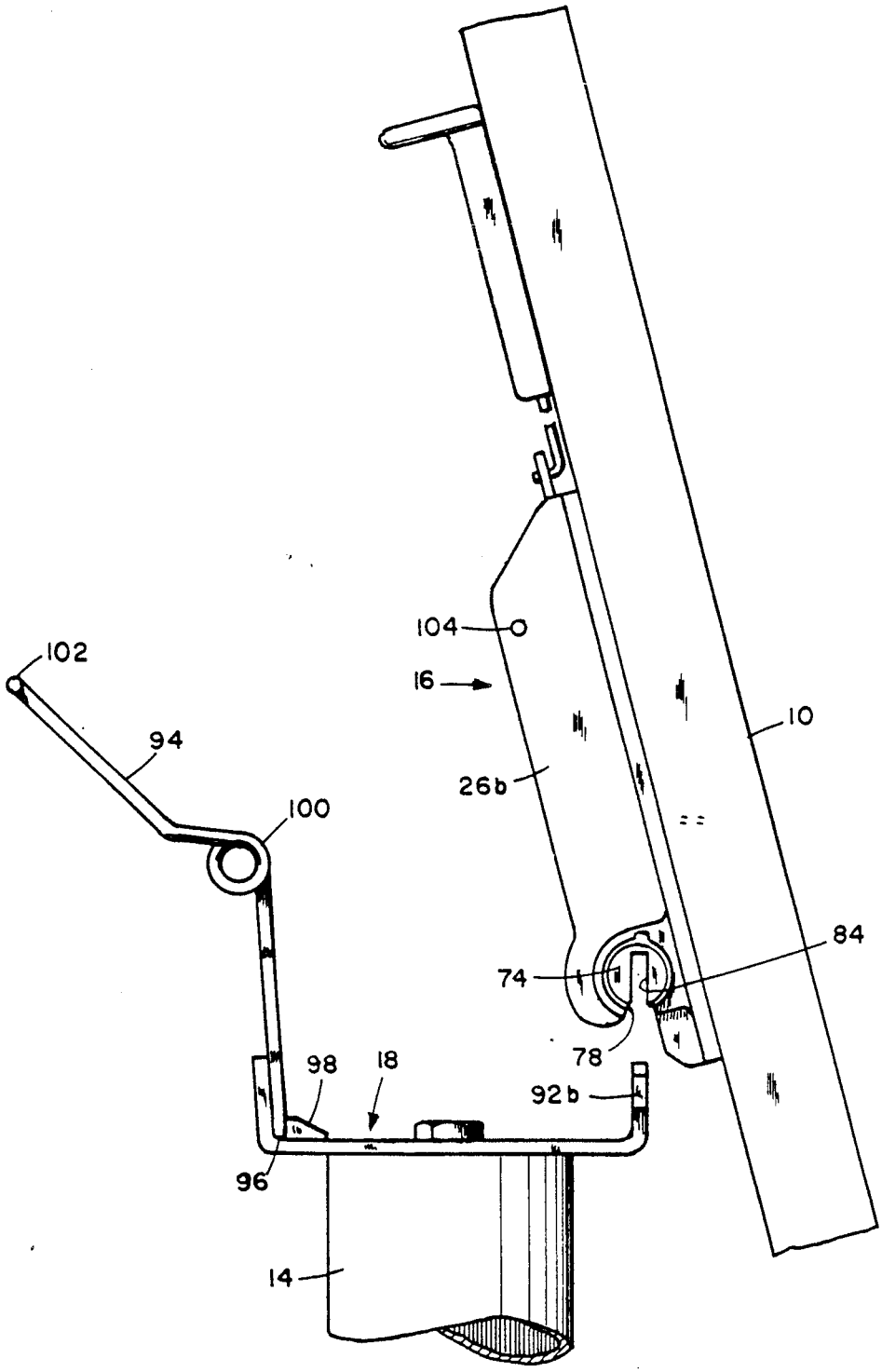

FIG. an elevational view, in partial cross-section, illustrating the mechanism in its closed condition;

FIG. 4 is a view of the locking mechanism as seen from the top with the table top removed and showing the mechanism in both its locked (left) and unlocked (right) configurations;

FIG. 5 is an enlarged elevational view, in partial cross-section, illustrating one of the replaceable bearings mounted in the FIG. 6 is a right end view of the structure illustrated in FIG. 5;

FIG. 7 is an illustration similar to FIG. 6 but showing the bearing in its "release" alignment;

FIG. 8 is an angled right projection of the structure of FIG. 7, illustrating the removal of the bearing of FIG. 7; and FIG. 9 an elevational view illustrating the manner in which the table top and the table leg may be assembled and disassembled.

BEST MODE FOR CARRYING OUT THE INVENTION

Figure 1:
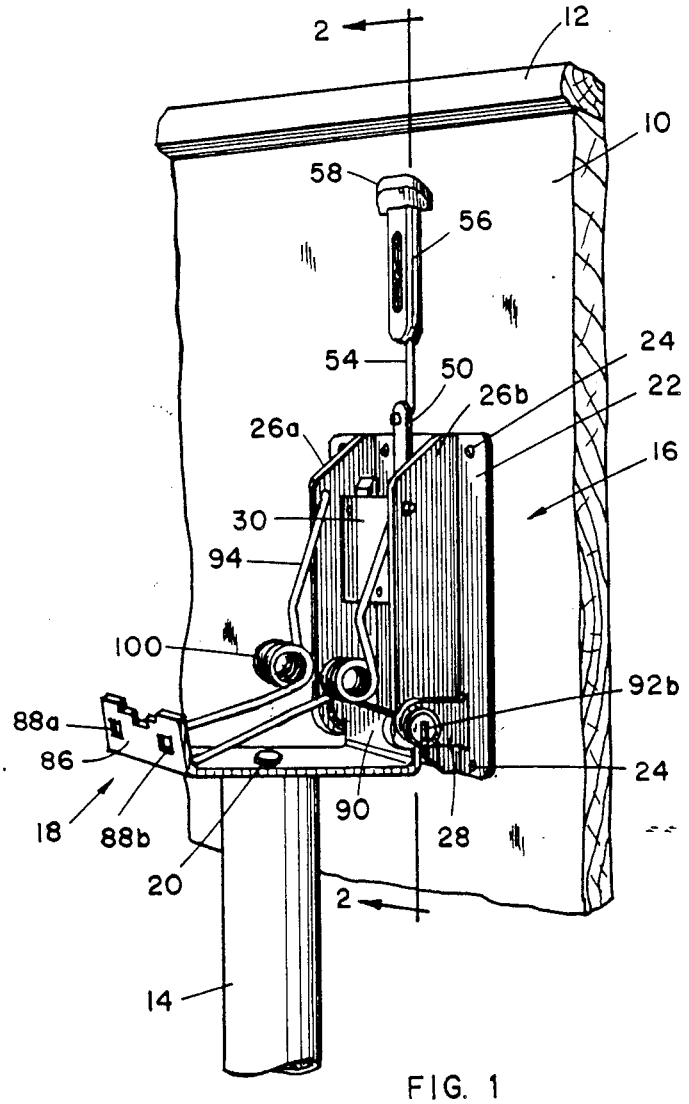
FIG. 1 is a perspective view of the mechanism of the invention in open, or tilted top, condition—the table top being shown largely broken away.

FIG. 1 illustrates the "clamshell" mechanism of this invention in its open position between a table top 10 having a depending edge 12 and the upper end of a table leg 14. The mechanism includes a chassis member 16 which is screwed to the underside of the table top 10 and a base plate 18 which pivots relative to chassis member 16 and is secured to the top of the leg 14 as by a bolt 20.

The chassis member 16 comprises an essentially rectangular plate 22 mounted to the table top by means of screws 24. It carries a pair of parallel ribs **26*a*, 26*b* which extend the length of the plate 22. The lower end of each rib, as viewed in FIG. 1, is thickened to provide a pivot support member in the form of a boss 28** which provides a supporting recess for one of the pivot bearings, as will be later described.

Extending between the ribs **26*a*, 26*b* is a latch housing 30. The latch housing 30 is illustrated in FIG. 4 as viewed through the table top 10 or with the table top removed. The housing is substantially rectangular and, at its ends, defines a pair of spaced, parallel, bolt channels 34*a*, 34*b*, each of substantially square cross-section. Mounted within each of these channels is a corresponding slide lock bolt 36*a*, 36*b*. Each of the slide lock bolts 36*a*, *b* has an angled camming surface 38 on its outer end. The upper surface of each of the slide lock bolts 36*a*,*b* is relieved to form a pair of opposed V-shaped camming shoulders 40, 42**.

Figure 2:
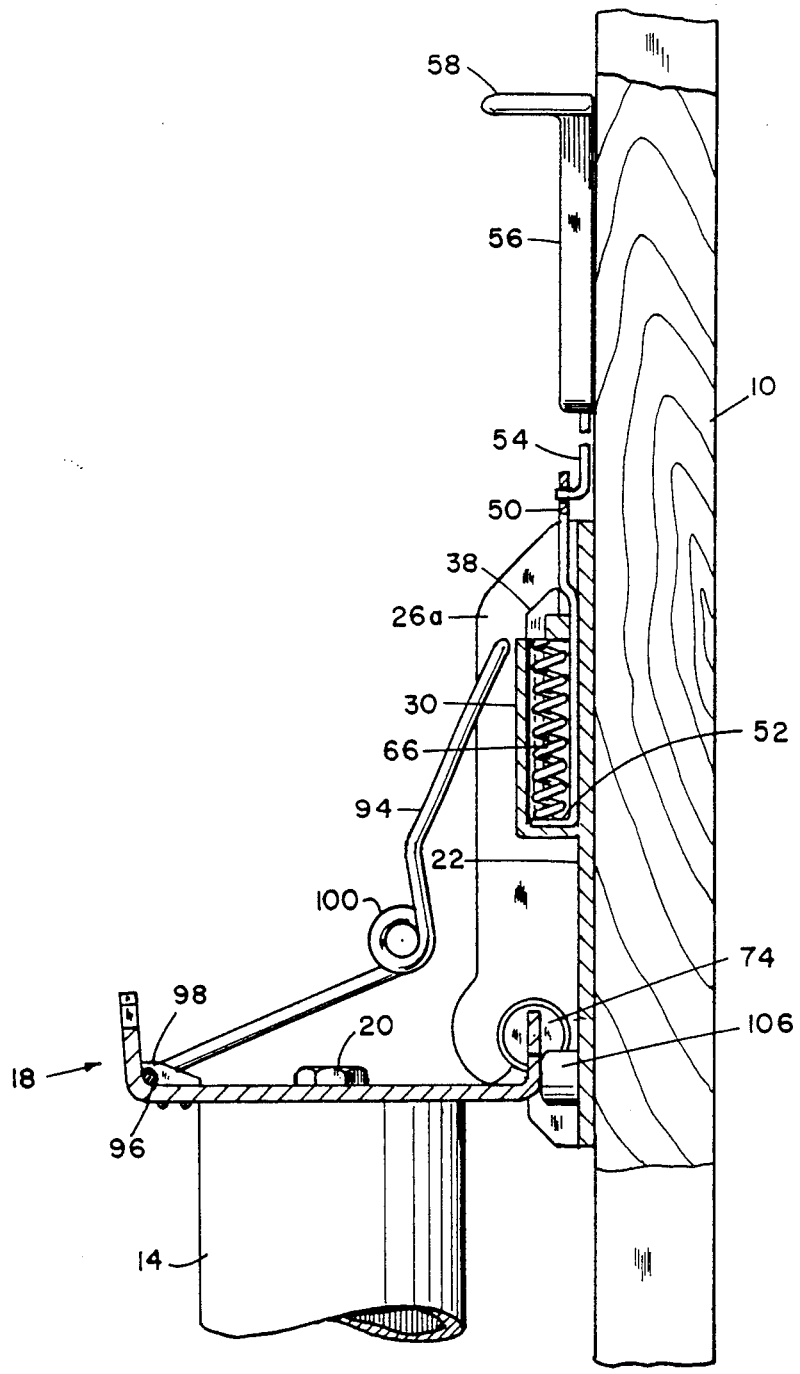
FIG 2 is an enlarged cross-sectional view taken substantially along the line 2—2 of FIG. 1.
Figure 3:
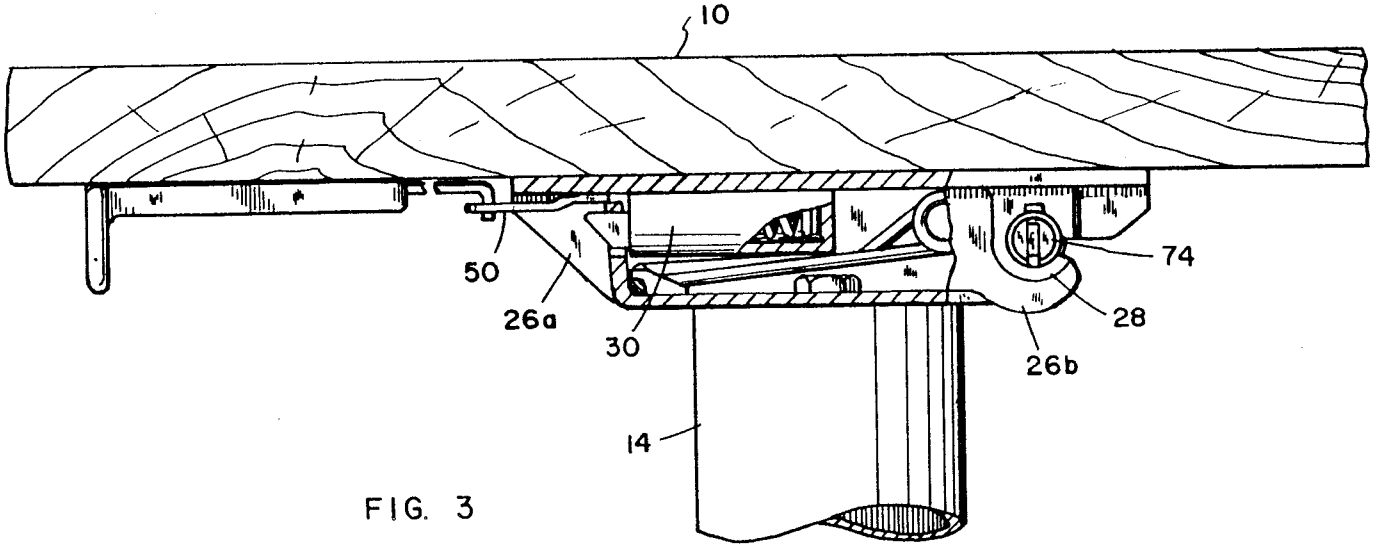

The central portion of the latch housing 30 is relieved to form a chamber including a pair of semicircular bearing surfaces 44*a*, 44*b*, each enclosing a respective central pivot pin 46*a*, 46*b*. The latch housing 30 also defines a narrow, rectangular, central opening 48. Passing through the opening 48 is an actuator arm 50. Actuator arm 50 is essentially a metal strap which is bent at its inner end to form a tab 52 (FIG. 2). At its opposite end the actuator arm 50 has a hole to which is connected the hooked end of a connecting rod 54. The connecting rod 54, in turn, extends from an actuator 56 having a finger pull 58. The actuator 56 is positioned to slide along the under surface of the table top 10 and defines a central recess 60 which cooperates with limit stops 62, 64 (FIG. 4) extending from the underside of the table top.

The actuator arm 50 is normally biased downwardly (as viewed in FIG. 4 by a spring 66 bearing against tab 52. Extending outwardly on either side of the actuator arm 50 are a pair of lobes 68. Each of the lobes 68 is connected to a different one of the slide lock bolts 36*a*, 36*b* by means of a rocker arm 70*a*, 70*b*. As will be seen, each of the rocker arms 70*a*, *b* includes a circular central portion mounted on one of the pivot pins 46 within the semicircular bearing surfaces 44. The innermost end of each of the rocker arms 70*a*, 70*b* defines a recess 72 which engages a corresponding lobe 68 of actuator arm 50. The opposite end of the rocker arm rests within the shoulders 40, 42 formed in its corresponding slide lock bolt 36*a*, 36*b*. It will thus be apparent that, with the actuator arm 50 biased downwardly as shown on the left side of FIG. 4, the rocker arm 70*a*, working against shoulder 40, drives the slide lock bolt 36*a* upwardly. However, when the actuator arm 50 is pulled upwardly against the force of the spring 66, the rocker arm 70*b*, shown in the right hand side of FIG. 4, rotates clockwise against the shoulder 42 to drive the slide lock bolt 36*b* downwardly.

The apparatus of this invention, employs two similar bearings 74, one of which is illustrated in FIGS. 5–8. The bearings may be formed of any suitable low-friction, abrasion resistant material. Nylon has been employed in one actual embodiment of the invention. The bearings are mounted in circular openings 76, passing through the bosses 28 on each of the ribs 26*a*, 26*b*. The circular openings 76 are not completely closed. Each includes a release opening or gap 78 as shown in FIGS. 6–8. Each of the bearings 74 is substantially cylindrical but has a circular head 80 at one end and a tab 82 on the other end. Extending substantially into the bearing 74, along its axis and from the side opposite the tab 82, is a slot 84 of rectangular cross section. During normal operation, the tab 82 serves to retain the bearing 74 in position as shown in FIGS. 5 and 6. However, the bearing may be removed for replacement by rotating it so that the tab 82 is aligned with the gap 78 as shown in FIG. 7. It can then be forced out of the opening 76 as shown in FIG. 8, the circumferential width of tab 82 being less than the width of gap 78. The remaining functions of the bearings 74 will be described below.

As is best illustrated in FIG. 1, the base plate 18 is bent at one end to form a latch plate 86 having square locking holes 88*a*, 88*b* engageable with the respective slide lock bolts 36*a*, 36*b* when in the closed position. It is bent at its other end to form a pivot axle 90 having a pivot tab 92*a*, 92*b* extending from each end.

The base plate 18 attached to the leg 14 is connected to the chassis member 16 by first rotating the bearings 74 so that their recesses 84 are aligned with the gaps 78 as shown in FIG. 9. In this position the pivot tabs 92*a*, 92*b* pass easily through the gaps 78 and into the slots 84 within the respective bearings 74. The remaining body of the base plate 18 is narrower than the space between the ribs 26*a*, 26*b*. Accordingly, counterclockwise rotation of the table top 10, as viewed in FIG. 9, causes the chassis 16 and base plate 18 to pivot together in clamshell fashion.

Interconnecting the chassis 16 and base plate 18 is a torsion spring 94. The torsion spring 94 is essentially U-shaped, the base 96 of the U being retained at the base of the latch plate 86 by means of a pair of spring retaining clips 98. Each arm of the U is formed into a spring coil 100 and the end 102 of each arm is bent to hook into openings 104 (FIG. 9) formed in each of the ribs 26*a*, 26*b*. Rubber bumpers 106 (FIG. 2) limit the rotation of table top 10.

OPERATION

As previously explained, the leg 14 of a table may be secured to to the top 10 by first aligning the two nylon bearings 74 to the position illustrated in FIG. 9 and inserting the pivot tabs 92*a*, *b* into the slots 84 of the bearings. The bent ends 102 of the torsion spring 94 are inserted into the openings 104 in the ribs 26*a*, 26*b*. The table top 10 is then lowered until the latch plate 86 on base plate 18 bears against the camming surfaces 38 of the slide lock bolts 36*a*, 36*b*. The lock bolts are pressed inwardly against the force of spring 66. Spring 66 then snaps the locking bolts through the locking holes 88*a*, 88*b*. This causes the top 10 to be rigidly and securely locked onto the top of the leg 14.

In order to tilt the table top 10 into storage position as shown in FIG. 2, the finger pull 58, which is positioned near the table edge, is merely retracted. This pulls the actuator arm 50 illustrated in FIG. 4 outwardly, thereby rotating the rocker arms 70*a*, 70*b* counterclockwise and clockwise respectively, to thereby withdraw each respective slide lock bolt 36*a*, 36*b*. This releases the base plate 18 and permits the table top 10 to be rotated vertically with the assistance of the torsion spring 94.

An additional feature of this invention permits ready assembly and disassembly of the leg and top. This is accomplished by removing the ends 102 of the torsion spring 94 from the openings 104 and rotating the table top 10 to the position illustrated in FIG. 9. In one embodiment, this happens to be an angle of 20° from vertical. In this position, the pivot tabs 92*a*, 92*b* of base plate 18 will pass readily through the gap 78 in each of the ribs 26*a*, 26*b*, permitting the table top 10 to be detached. This function is useful for both storing and shipping of tables. It also permits selective combinations of various sized and shaped table tops and leg designs. As previously explained, the bearings 74 are also easily removed and replaced when necessary.

It is believed that the many advantages of this invention will now be apparent to those skilled in the art. It will also be apparent that a number of variations and modifications may be made therein without departing from its spirit and scope. This invention is limited only by the scope of the following claims.

I claim:

1. A table top tilting mechanism for a table having a top with an underside and at least one leg having an upper end and a lower end which comprises:

a chassis member mountable on the underside of said table top having first and second coaxial spaced pivot support members thereon defining respective first and second aligned release openings therethrough parallel to their common axis;

a locking bolt carried by said chassis member operable between an extended locking position and a retracted unlocking position;

means for biasing said locking bolt into said locking position;

release handle means mountable on said table top for retracting said locking bolt to its unlocking position;

a base plate securable to the upper end of the table top, said base plate having a first end defining a locking hole engageable with said locking bolt and a second end carrying first and second spaced pivots; and first and second pivot bearings rotatably mounted, respectively, in said first and second pivot support members, each of said bearings defining a slot for receiving a respective one of said first and second pivots, said slots being alignable with said release openings to permit said base plate to be attached to or detached from said chassis member.

2. The mechanism of claim 1 wherein each of said pivot bearings is substantially cylindrical, with a first and a second end, and said slot extends substantially diametrically therethrough between the first and second ends.

3. The mechanism of claim 2 wherein each of said pivot bearings includes an enlarged head at its first end.

4. The mechanism of claim 3 wherein each of said pivot bearings includes a locking tab extending radially outward from its second end, the circumferential width of said tab permitting it to pass through said release opening.

5. A table top tilting mechanism for a table having a top with an underside and at least one top having an upper end and a lower end which comprise:

a chassis member mountable on the underside of said table top having first and second coaxial spaced pivot support members thereon defining respective first and second aligned release openings therethrough parallel to their common axis;

first and second spaced, parallel, locking bolts carried by said chassis member, each operable between an extended looking position and a retracted unlocking position;

means for substantially simultaneously biasing said locking bolts into their locking positions;

release handle means mountable on said table top for retracting said locking bolts to their unlocking positions;

a base plate securable to the upper end of the table leg, said base plate having a first end defining first and second spaced locking engageable, respectively, with said first and second locking bolts and a second end carrying first and second spaced pivots; and first and second pivot bearings rotatably mounted, respectively, in said first and second pivot support members, each of said bearings defining a slot for receiving a respective one of said first and second pivots, said slots being alignable with said release openings to permit said base plate to be attached to or detached from said chassis member.

6. The mechanism of claim 5 wherein said biasing means and release handle means comprise:

an actuator arm intermediate said locking bolts and manually movable parallel thereto between a locking and an unlocking position;

spring means for normally biasing said actuator arm to its locking position; and link means interconnecting said actuator arm and said locking bolts for extending said locking bolts into their locking positions when said actuator arm is in its locking position and retracting said locking bolts into their unlocking positions when said actuator arm is in its unlocking position.

7. The mechanism of claim 6 wherein said link means comprises:

a first rotatable rocker arm having a first end pivotally engaging said actuator arm and a second end pivotally engaging said first locking bolt; and a second rotatable rocker arm having a first end pivotally engaging said actuator arm and a second end pivotally engaging said second locking bolt.

8. The mechanism of claim 5 wherein each of said pivot bearings is substantially cylindrical, with a bearing first end and a bearing second end, and said slot extends substantially diametrically therethrough between the bearing first and second ends.

9. The mechanism of claim 8 wherein each of said pivot bearings includes an enlarged head at its first end.

10. The mechanism of claim 9 wherein each of said pivot bearings includes a locking tab extending radially outward from its second end, the circumferential width of said tab permitting it to pass through said release opening.

11. In a table top having a top with an underside and at least one leg having an upper end and a lower end, a top tilting mechanism which comprises:

first and second coaxial spaced pivot support members mounted on one of (a) the table top underside or (b) the leg upper end, the pivot support members defining respective first and second aligned release openings therethrough parallel to their common axis;

a locking bolt carried by the underside of said table top for operation between an extended locking position and a retracted unlocking position;

means for biasing said locking bolt into said locking position;

release handle means mounted to the underside of said table top for retracting said locking bolt to its unlocking position;

latching means carried by the upper end of said leg for engagement with said locking bolt;

first and second spaced pivots carried by that one of (a) the table top or (b) the upper leg end which is not carrying the pivot support members; and first and second pivot bearings rotatably mounted, respectively, in said first and second pivot support members, each of said bearings defining a slot for receiving a respective one of said first and second pivots, said slots being alignable with said release openings to permit said table top to be attached to or detached from said upper leg end.

* * * * *

UNITED STATES PATENT AND TRADEMARK OFFICE

CERTIFICATE OF CORRECTION

PATENT NO. : 4,986,195

DATED : Jan. 22, 1991

INVENTOR(S) : Niels Diffrient

It is certified that error appears in the above-identified patent and that said Letters Patent is hereby corrected as shown below:

| | |
|---|---|
| ABSTRACT, line 11: | Delete "horizonal" and substitute therefor --horizontal--. |
| Col. 2, line 14: | After "in" insert --its--. |
| Col. 2, line 18: | After "FIG." insert the number --3--. |
| Col. 2, line 26: | After "the" insert --mechanism;--. |
| Col. 3, line 17: | After the number "4" insert --)--. |
| Col. 3, line 65: | After "pivot" insert --in the form of a--. |
| Col. 5, line 12: | Delete "top" and substitute therefor --leg--. |
| Col. 5, line 37: | Delete "comprise" and substitute therefor --comprises--. |
| Col. 5, line 47: | Delete "looking" and substitute therefor --locking--. |

UNITED STATES PATENT AND TRADEMARK OFFICE

CERTIFICATE OF CORRECTION

PATENT NO. : 4,986,195

DATED : Jan. 22, 1991

INVENTOR(S) : Niels Diffrient

It is certified that error appears in the above-identified patent and that said Letters Patent is hereby corrected as shown below:

Col. 5, line 57: After "locking" insert --holes--.

Col. 6, line 36: Delete "top".

Signed and Sealed this

Eighth Day of September, 1992

*Attest:*

*Attesting Officer*

DOUGLAS B. COMER

*Acting Commissioner of Patents and Trademarks*